US005591111A

United States Patent [19]

Wang et al.

[11] Patent Number: 5,591,111

[45] Date of Patent: Jan. 7, 1997

[54] SIT-UP EXERCISE APPARATUS

[75] Inventors: Leao Wang; Peter Wu, both of Taichung Hsien, Taiwan

[73] Assignee: Greenmaster Industrial Corp., Taichung Hsien, Taiwan

[21] Appl. No.: 626,931

[22] Filed: Apr. 3, 1996

[51] Int. Cl.[6] ..... A63B 23/02

[52] U.S. Cl. ..... 482/140; 482/132; 482/142

[58] Field of Search ..... 482/10, 78, 95, 482/96, 131, 132, 133, 140, 142, 144, 148, 907, 908; 297/258, 260, 271.5, 271.6, 272.1, 272, 408; 472/135; D21/191, 193

[56] References Cited

U.S. PATENT DOCUMENTS

| | | | |
|---|---|---|---|
| 2,722,967 | 11/1955 | Reinholz | 482/142 |
| 5,447,483 | 9/1995 | Liang | 482/132 |
| 5,492,520 | 2/1996 | Brown | 482/140 |

FOREIGN PATENT DOCUMENTS

| | | | |
|---|---|---|---|
| 9012623 | 11/1990 | WIPO | 482/132 |

*Primary Examiner*—Jerome Donnelly
*Assistant Examiner*—Jeanne M. Clark
*Attorney, Agent, or Firm*—Bacon & Thomas

[57] ABSTRACT

A sit-up exercise apparatus includes a substantially inverted-U shaped handle bar and a support bar provided with a head rest firmly secured to the side arms of the handle bar. A shaft is provided at each end of the handle bar and is fitted with a roller having a sector-like slot, a spring capable of rotation with the shaft and the roller, and a bolt for limiting rotation of the shaft and roller. Each roller is also tightly fitted with a cover. The rollers are capable of rearward or forward rotation with the forward push or rearward pull of the handle bar to a suitable extent. By means of the springs and the bolts, rotation of the rollers as well as the forward displacement of the handle bar may be controlled, achieving an excellent exercise apparatus which is safe and comfortable to operate.

2 Claims, 8 Drawing Sheets

SIT-UP EXERCISE APPARATUS

BACKGROUND OF THE INVENTION (a) Field of the Invention

The present invention relates generally to an exercise apparatus, and more particularly to a sit-up exercise apparatus which is safe, smooth and comfortable to operate.

(b) Description of the Prior Art

A prior sit-up exercise apparatus 10 is shown in FIG. 1. The prior apparatus essentially comprises two curved bars 11 arranged in a parallel relation at opposite ends of an inverted-U shaped stem 12. The stem 12 has a middle section with a head rest 13 disposed thereon and a curved stem 14 extending therefrom. The end of the curved stem 14 is connected to a horizontally disposed hand grip 15. Each of the curved bars 11 has a pad 16 substantially vertically provided thereon at a suitable position. With reference to FIG. 2 which illustrates operation of the prior apparatus 10, a user lies flat between the curved bars 11 with his/her head resting on the head rest 13 and both hands gripping the ends of the hand grip 15. When the user pushes the hand grip 15 forwardly, the curved bars 11, by means of their curved sections 111 as the pivots, will rotarily displace forwardly so that the upper trunk of the user rises. However, it has been found that users of this type of sit-up exercise apparatus are quite uncomfortable and scared when using it. This is because when the user pushes the hand grip 15 forcefully forward so as to lift the trunk, the pivots of the apparatus, i.e., the curved sections 111 of the curved bars 11, will be subjected to the reverse action of the forward force to displace rearwardly, so that a pivot A displaces forwardly to near a point B closer to the end of the curved section 111, and when the apparatus 10 displaces rearwardly and then forwardly again with the push of the user's hands on the hand grip 15, the pivot A will shift to A', and the pivot A' will displace forwardly to the point B'. As a result, with every push of the hand grip 15, the pivot of the apparatus shifts forwardly, affecting the user's operation of the apparatus. Worse still, if the user exerts an excessive force on the hand grip 15, the whole apparatus might overturn and hurt the user.

There is another type of sit-up apparatus designed to overcome the drawbacks with the above-described apparatus. With reference to FIG. 3, a sit-up exercise apparatus 20 essentially comprises a U-shaped bottom bar 21 with two slightly curved ends, a head rest 22 fixedly disposed at a straight section 211 of the bottom bar 21, an inverted-U shaped handle bar 23 having its ends fixed secured to two side arms 212 of the bottom bar 21, and a support seat 24 is pivotally mounted at each curved end of the bottom bar 21. In use, the user lies flat between the two side arms 212 of the bottom bar 21 with his/her head resting on the head rest 22. When the user grips the handle bar 23 and pushes forwardly, the bottom bar 21 will rotarily displace upwardly with the support seats 24 as the pivots, lifting the user's trunk. At this time, as the apparatus 20 is provided with two support seats 24 as the pivots, undue displacement of the pivots when the user exerts a force on the handle bar 23 to bring the bottom bar 21 to rotarily displace may be prevented. In other words, the entire apparatus 20 will not displace rearwardly with the movement of the user. However, such a design engenders another problem. With reference to FIG. 4, when the user exerts a force on the handle bar 23 to lift his/her trunk up, the apparatus 20 utilizes the support seats 24 as its pivots so that the bottom bar 21 displaces through an angle with the handle bar 23, so that the user's body is supported by his/her buttocks and his/her upper trunk lifted by the bottom bar 21. However, as can be seen from FIG. 4, a distance C from the support seats 24 to the head rest 22 and a distance D from the user's buttocks to the head rest 22 is different (i.e., the radius of rotation is not the same). Therefore, when the bottom bar 21 displaces upwardly and the user's upper trunk is lifted, the user's head will move away from the head rest 22 so that only a part thereof or the neck touches the head rest 22, which is very uncomfortable and will thus affect the exercising effects.

SUMMARY OF THE INVENTION

Accordingly, a primary object of the present invention is to provide a sit-up exercise apparatus which is safe, smooth and comfortable to operate.

In order to achieve the above-mentioned object, a preferred embodiment of the sit-up exercise apparatus of the invention essentially comprises a handle bar having a horizontally disposed shaft at each end, the shaft having fitted thereon a roller with a sector-like slot, a spring capable of rotation with the shaft and the roller and being compressed, a bolt for restricting rotation of the shaft and the roller, and a cover being tightly fitted onto the roller. In use, the rollers at the ends of the handle bar serve as pivots which may displace forwardly or rearwardly to a suitable extent with the forward push or rearward pull of the handle bar by the user, and by means of the resilience of the springs and the positioning effects of the bolts, rotation of the rollers and the forward displacement of the handle bar may be controlled, achieving a sit-up exercise apparatus which is safe, smooth and comfortable to operate.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 5:
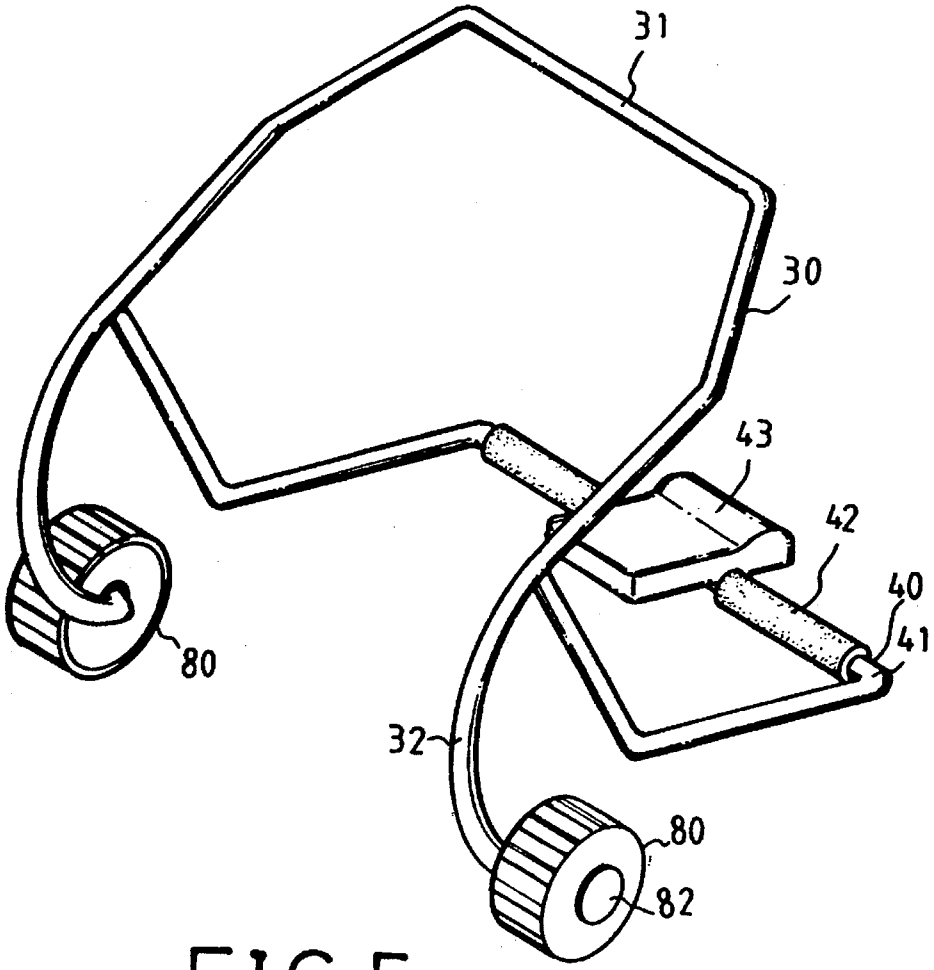
FIG. 5 is an elevational view of a preferred embodiment of the sit-up exercise apparatus of the present invention.
Figure 6:
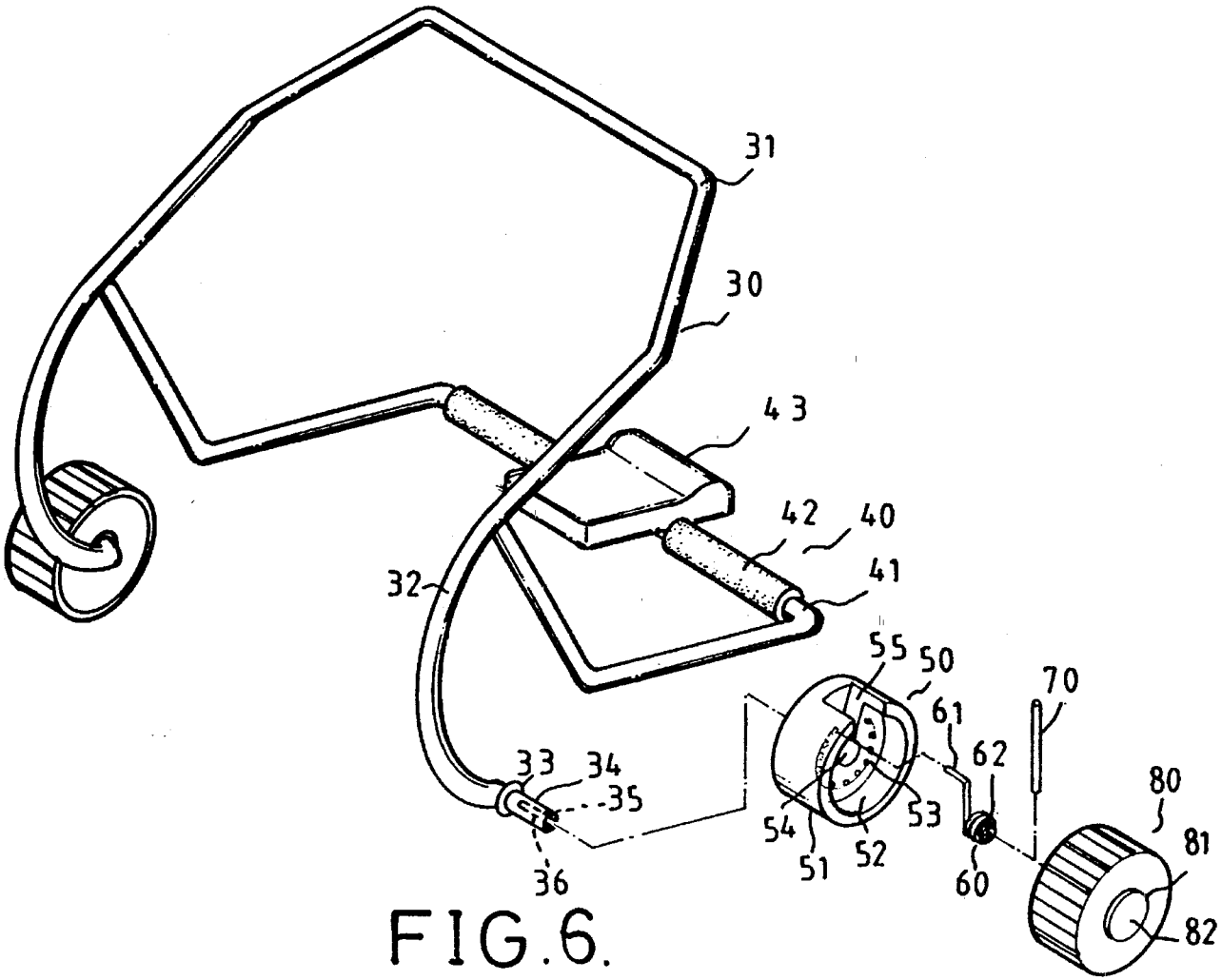
FIG. 6 is an elevational exploded view of the preferred embodiment of the sit-up exercise apparatus of the present invention.

With reference to FIGS. 5 and 6, a preferred embodiment of the sit-up exercise apparatus according to the present invention essentially comprises a handle bar 30, a support bar 40 having its ends fixedly connected to the handle bar 30 at suitable positions, a couple of rollers 50 each fitted with a spring 60, a bolt 70 and a cover 80 mounted to both ends of the handle bar 30 respectively.

The handle bar 30 is substantially an inverted-U shaped bar having two side arms 32 with substantially curved lower sections and an upper straight section 31 configured to allow a user's gripping. The extreme end of each side arm 32 is respectively provided with a stop piece 33 and a transversely oriented hollow shaft 34 which has a bolt hole 35 penetrating therethrough at a suitable position and a transversely oriented slot 36 of a predetermined length.

The support bar 40 is a substantially U-shaped bar having both side arms slightly bent. It is fixedly provided at predetermined positions of the two side arms 32 respectively and has a straight section 41. A head rest 43 is disposed at the middle of the straight section 41 and two foam rubber jackets 42 are fitted onto the straight section 41 at both sides of the head rest 43.

The rollers 50 are respectively fitted onto the shafts 34 at both ends of the handle bar 30. Each of the rollers 50 consists of a body 51 having a side wall circumferentially provided with multiple positioning holes 53 and a central shaft hole 54, and a annular wall 52 an indentation extending from the side wall, a sector-like slot 55 being formed from the notch of the annular wall 52 to the central shaft hole 54 and communicating with the central shaft hole 54.

The spring 60 is fitted on the shaft 34 and is surrounded by the annular wall 52. The spring 60 having a first end 61 extending vertically upward and being bent through 90 degrees so that it may be retained in one of the positioning hole 53 of the roller 50 and a second end 62 bent horizontally so that it may hook into the slot 36 of the shaft 34.

The bolt 70 is inserted from the position of the sector-like slot 55 of the roller 50 into the bolt hole 35 of the shaft 34 such that the roller 50 is restricted thereby and accommodated between the bolt 70 and the stop piece 33. Besides, the roller 50 will be baffled by the bolt 70 so that it may only displace through the distance of arc of the sector-like slot 55.

The cover 80 is tightly fitted onto the roller 50 such that the spring 60 and the bolt 70 may be encapsulated thereby. The cover 80 has a shaft hole 81 fitted with a decorative ring 82.

Figure 1:
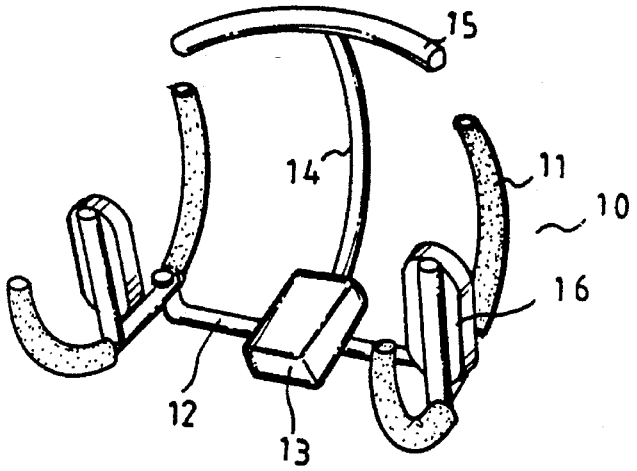
FIG. 1. PRIOR ART
FIG. 1 is an elevational view of a prior sit-up exercise apparatus.
Figure 3:
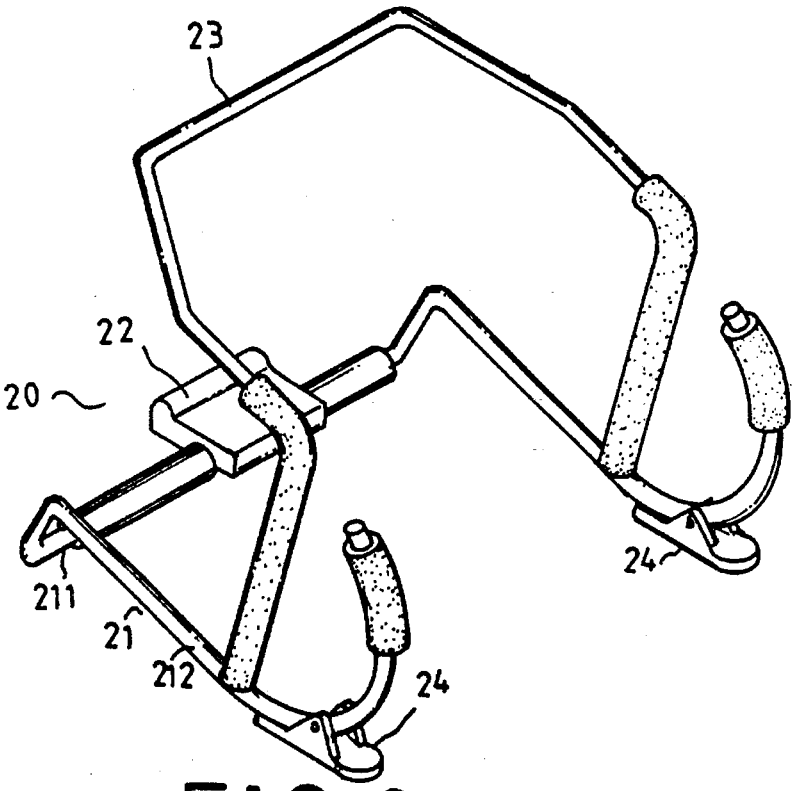
FIG. 3. PRIOR ART
FIG. 3 is an elevational view of another prior sit-up exercise apparatus.
Figure 2:
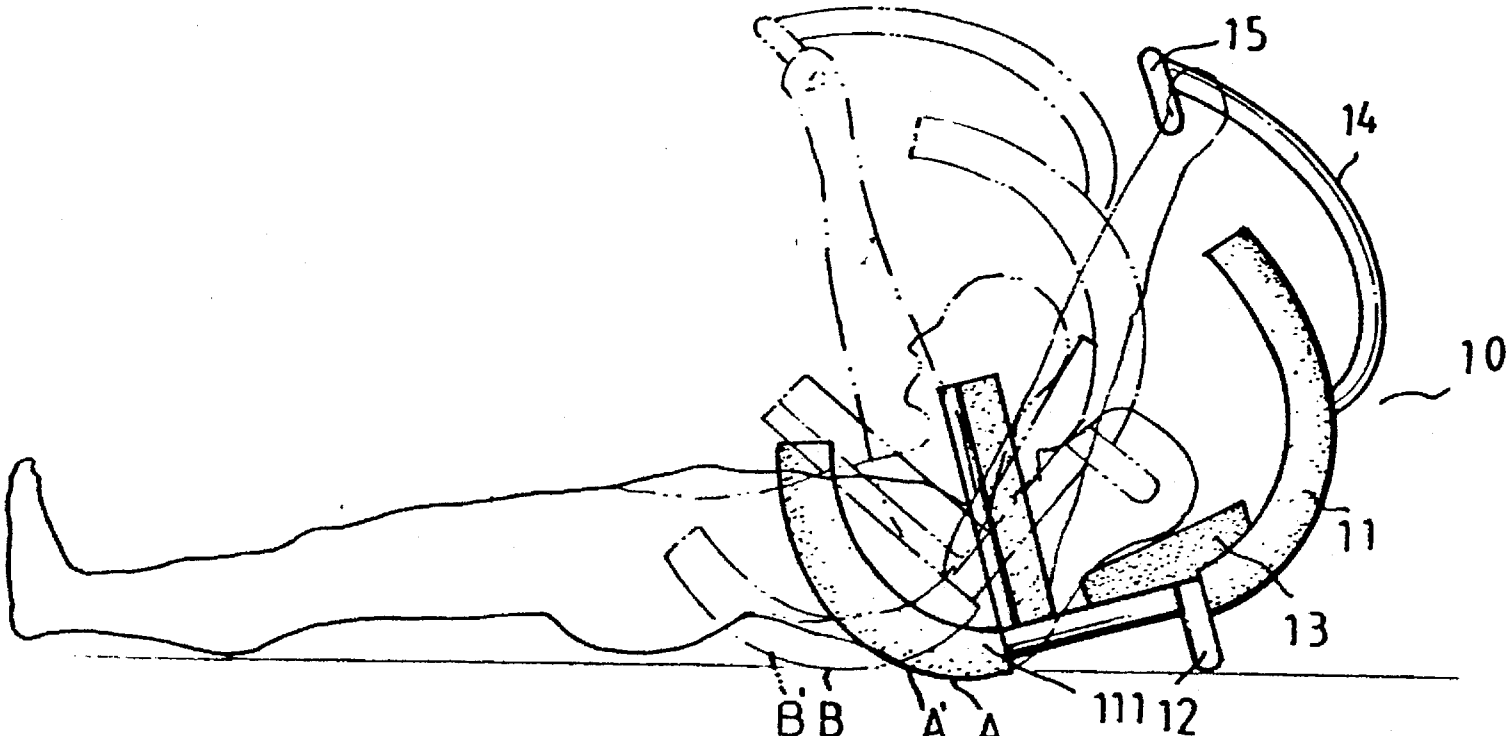
FIG. 2 PRIOR ART
FIG. 2 is a schematic view illustrating operation of the prior sit-up exercise apparatus.
Figure 4:
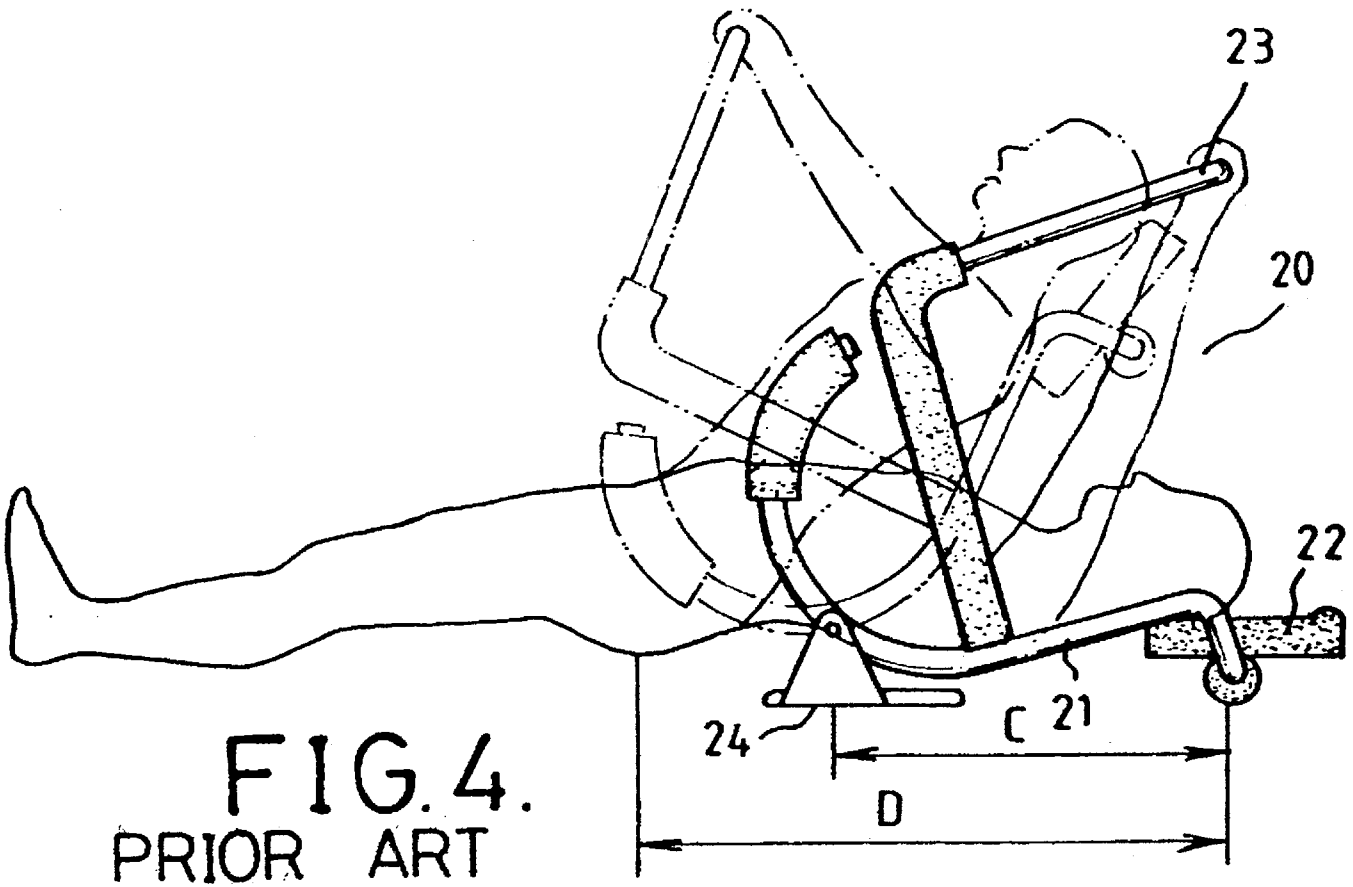
FIG. 4. PRIOR ART
FIG. 4 is a schematic view illustrating operation of the prior sit-up exercise apparatus shown in FIG. 3.
Figure 7:
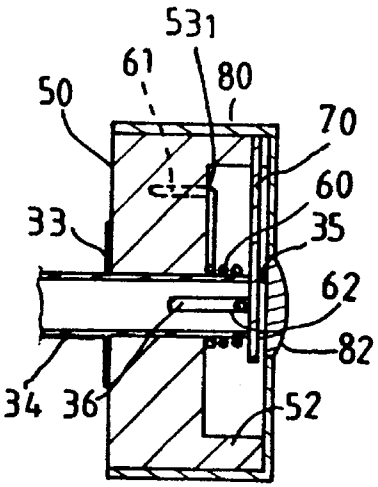
FIG. 7 is a sectional view of a roller of the sit-up exercise apparatus of the present invention.
Figure 8:
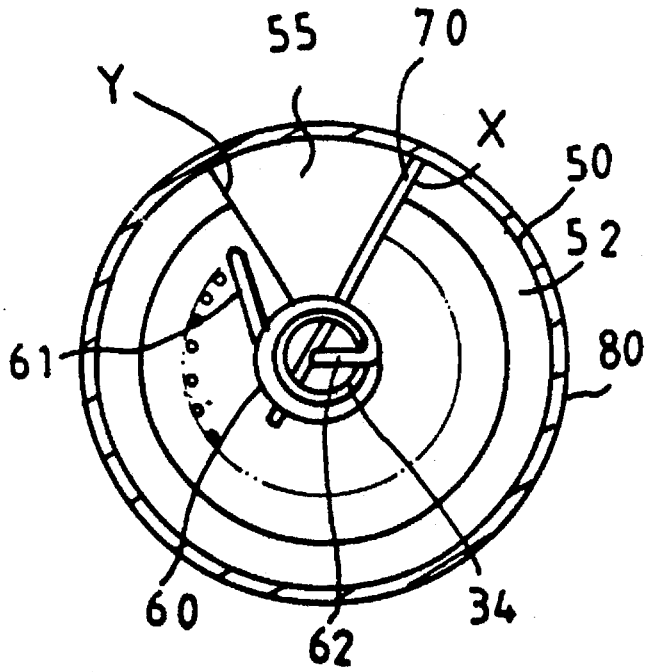
FIG. 8 is a side view of tile roller of the sit-up exercise apparatus of the present invention.

The components of the preferred embodiment of the sit-up exercise apparatus of the present invention and their relative relationship have been described as above. Reference is now made to FIGS. 7–8 which illustrate assembly of the sit-up exercise apparatus. First of all, the rollers 50 are respectively fitted onto the shafts 34 at both ends of the handle bar 30. Then the spring 60 is fitted onto each shaft 34 so that is is located within the annular wall 52 of the roller 50 with the first end 61 engaging one of the positioning holes 531 of the roller and the the second end 62 hooking the slot 36 of the shaft 34, such that the roller 50 may not freely move even when subjected to 25 external, forces. The bolt 70 is then inserted downwardly from the position of the sector-like slot 55 of the roller 50 into the bolt hole 35 of the shaft 34 so that the roller 50 is baffled by the bolt 70 and thus located between the bolt 70 and the stop piece 30, the bolt 70 urging against a side wall X of the sector-like slot 55 of the roller 50. The cover 80 is finally fitted onto the roller 50 and the decorative ring 82 inserted into the shaft hole 81 of the cover 80.

Figure 9:
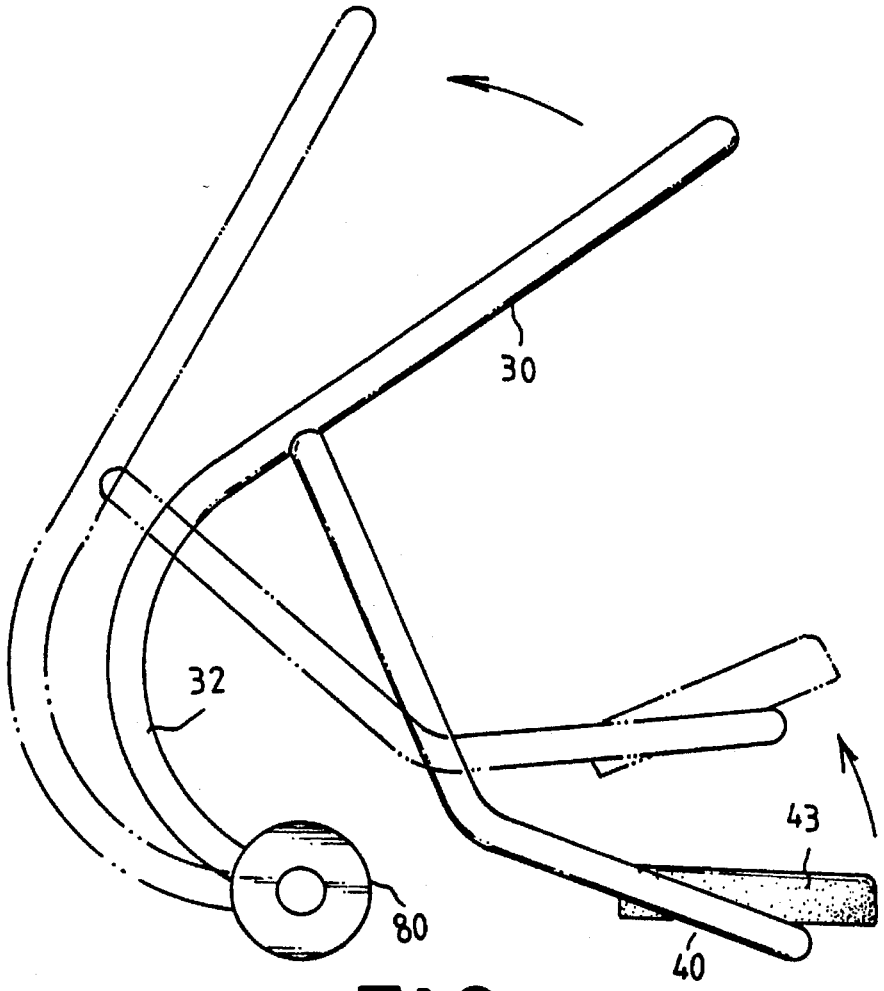
FIG. 9 is a schematic view showing the forward displacement of a handle bar of the sit-up exercise apparatus when it is pushed to a small extent.
Figure 10:
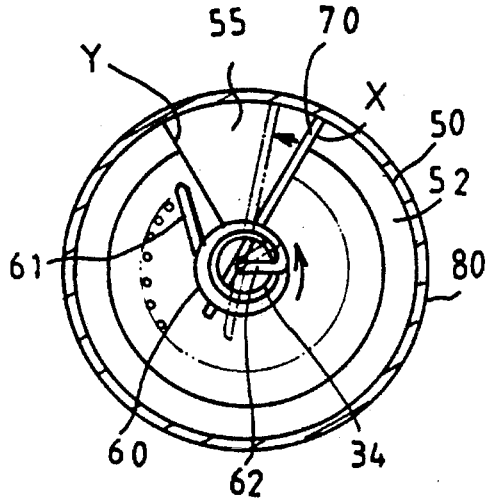
FIG. 10 is a sectional view illustrating the state of the roller when the handle bar is pushed forwardly to a small extent.
Figure 11:
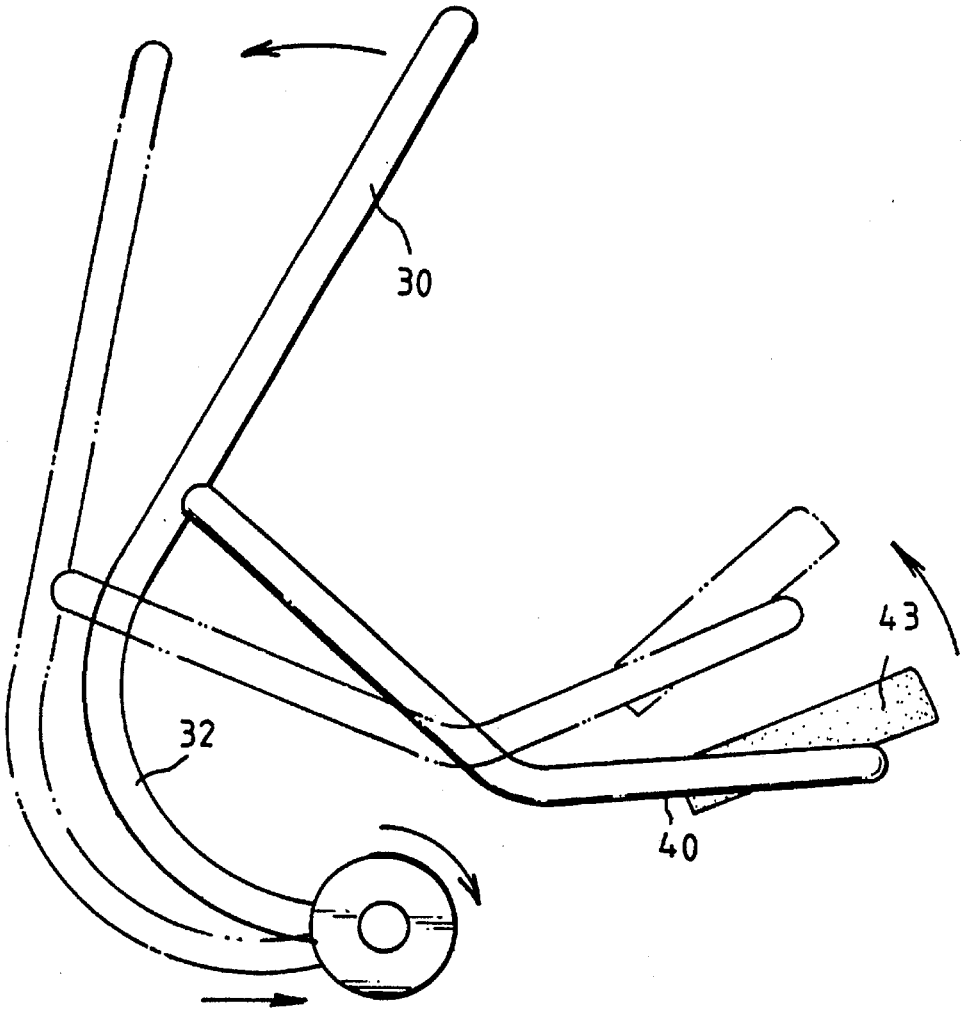
FIG. 11 is a schematic view showing the forward displacement of the handle bar of the sit-up exercise apparatus when it is pushed to a full extent.
Figure 12:
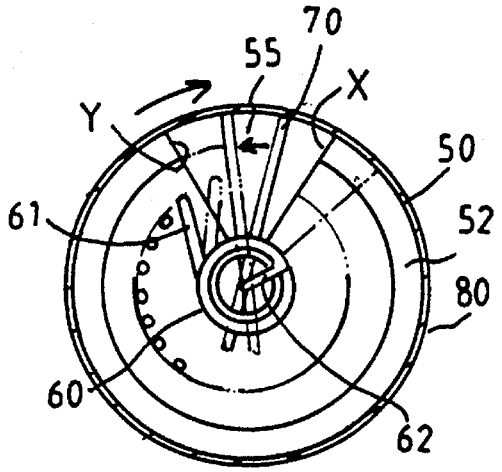
FIG. 12 is a sectional view illustrating the state of the roller when the handle bar is pushed forwardly to a full extent.

By means of the above arrangement, the sit-up exercise apparatus thus assembled will appear as that shown in FIG. 5, in which the rollers 50 at the ends of the handle bar rest on the floor to serve as supports or pivots, and the straight section 41 of the support bar 40 fixedly to the side arms 32 of the handle bar 30 also rests on the floor. In other words, under normal circumstances, the head rest 43 is slightly above the floor, and the straight section 31 of the handle bar 30 for gripping purposes is located above the head rest Operation of the sit-up exercise apparatus of the invention is described with reference to FIGS. 9–10. When the user grips the straight section 31 of the handle bar 30 and pushes forwardly, the shaft 34 and the bolt 70 locked therein starts turning forwardly. At this point, the rollers 50 are subjected to a downward force so that they remain stationary, so that the springs 60 use their first ends 61 as pivots, while their second ends 62 hooking the the shaft 34 are being tightly squeezed. When the handle bar 30 is still being pushed forwardly, with reference to FIGS. 11–12, since the lower sections of the side arms 32 are curved, there forms a rearward force at the ends of the handle bar 30, so that the rollers 50 may roll rearwardly. Therefore, even when the handle bar 30 and the support bar 40 displace upwardly, the user's head may still rest comfortably on the head rest 43. As for the first ends 61 of the springs 60, they rotate with the rollers 50 and are being squeezed tightly until a side wall Y of the sector-like slot 55 of the roller 50 is checked by the forwardly rotating bolt 70 and is thus positioned. In other words, the bolts 70 are urging against the side walls Y of the sector-like slots 55 of the rollers 50 so that the rollers 50 stop rotation, impeding the handle bar 30 from being pushed forwardly. Furthermore, when the user relaxes his/her arms and the handle bar 30 is pulled towards the user's body, the rollers 50 are subjected to the resilience of the springs 60 which have been previously squeezed and start rotating forwardly, so that the user's head may rest against the head rest 43, causing the bolts 70 to reset and urge against the side walls X of the sector-like slots 55 of the rollers and the straight section 41 of the support bar 40 to rest on the floor again. As can be seen from the above, the operation of the sit-up exercise apparatus of the invention is excellent and ergonomically designed to eliminate discomfort in sit-up exercises and ensure safety.

Although the present invention has been illustrated and described with reference to the preferred embodiment thereof, it should be understood that it is in no way limited to the details of such embodiment but is capable of numerous modifications within the scope of the appended claims.

What is claimed is:

1. A sit-up exercise apparatus, comprising:

a handle bar of a substantially inverted U-shaped structure, said handle bar having a middle straight section for gripping purposes and two side arms with curved lower sections, each end of said handle bar being fitted with a stop piece and a horizontally oriented hollow shaft, said shaft having a shaft hole and a transversely oriented slot of a predetermined length;

a support bar of a substantially U-shaped structure, said support bar having a middle straight section and two slightly bent side sections which are fixedly secured to said side arms of said handle bar at predetermined positions, a head rest being provided at said straight section thereof;

two rollers respectively fitted onto said shafts at both ends of said handle bar, each of said rollers having a side wall with a central shaft hole and multiple positioning holes and an annular wall extending from said side wall, a sector-like slot being formed from a notch of said annular wall to said central shaft hole, said sector-like slot communicating with said central shaft hole;

two springs fitted onto said shafts and accommodated within said annular walls of said rollers respectively, each of said springs having a first end engaging one of said positioning holes of said roller and a second end engaging said slot of said shaft;

two bolts, each of which is inserted downwardly from said sector-like slot of said roller into said shaft hole of said shaft such that said roller is restricted by said bolt to be located between said bolt and said stop piece; and two covers tightly fitted onto said rollers respectively.

2. A sit-up exercise apparatus as claimed in claim 1, wherein said first end of each of said two springs is configured to extend vertically upward and bend through 90 degrees while said second end thereof is bent horizontally.

* * * * *